US009822501B2

(12) United States Patent
Younce et al.

(10) Patent No.: US 9,822,501 B2
(45) Date of Patent: Nov. 21, 2017

(54) DUAL ARM FORTIFIED BARRIER ASSEMBLY

(71) Applicant: Hy-Security Gate, Inc., Kent, WA (US)

(72) Inventors: David Younce, Black Diamond, WA (US); Brian G. DeNault, Seattle, WA (US); Steven A. Carlsen, Bothell, WA (US)

(73) Assignee: Oculus VR, LLC, Menlo Park, CA (US)

( * ) Notice: Subject to any disclaimer, the term of this patent is extended or adjusted under 35 U.S.C. 154(b) by 0 days.

(21) Appl. No.: 14/642,626

(22) Filed: Mar. 9, 2015

(65) Prior Publication Data

US 2016/0002870 A1 Jan. 7, 2016

Related U.S. Application Data

(63) Continuation of application No. 13/624,754, filed on Sep. 21, 2012, now abandoned.

(Continued)

(51) Int. Cl.

*E01F 13/06* (2006.01)
*G08G 1/095* (2006.01)

(Continued)

(52) U.S. Cl.

CPC ..... *E01F 13/06* (2013.01); *E01F 9/00* (2013.01); *E01F 13/10* (2013.01); *E01F 13/12* (2013.01);

(Continued)

(58) Field of Classification Search

CPC ..... E01F 15/0438; E01F 15/12; E01F 15/53; E01F 15/60; E01F 15/14; E01F 15/04;

(Continued)

(56) References Cited

U.S. PATENT DOCUMENTS 5,299,386 A * 4/1994 Naegelli ..... E01F 13/06 49/27
5,459,963 A * 10/1995 Alexander ..... E01F 13/06 49/34

(Continued)

OTHER PUBLICATIONS

PRO Barrier Engineering LLC, The Arrestor, www.probarrier.com archived Jul. 16, 2009.*

*Primary Examiner* — Thomas B Will
*Assistant Examiner* — Jessica H Lutz
(74) *Attorney, Agent, or Firm* — Perkins Coie LLP

(57) ABSTRACT

A dual arm barrier assembly comprising spaced-apart stanchions and a pair of barrier arms pivotally connected to a first stanchion for movement between closed and open positions. The barrier arms have distal end portions immediately adjacent to and out of engagement with the second stanchion when in the closed position during normal operation and when the vehicle is out of engagement with the barrier arms. The first barrier arm in the closed position is at a height corresponding to vehicle's windshield, and the second barrier arm in the closed position is below the first barrier arm and is at a height corresponding approximately to the vehicle's body or frame. The second stanchion engages the barrier arms only when the vehicle presses against barrier arms, thereby securely retaining the barrier arms in the closed position.

14 Claims, 13 Drawing Sheets

Related U.S. Application Data

(60) Provisional application No. 61/537,183, filed on Sep. 21, 2011.

(51) Int. Cl.

| | |
|---|---|
| ***E01F 13/12*** | (2006.01) |
| ***E05F 15/53*** | (2015.01) |
| ***E05F 15/60*** | (2015.01) |
| ***E01F 9/00*** | (2016.01) |
| ***E01F 13/10*** | (2006.01) |
| ***E01F 15/14*** | (2006.01) |
| ***E05D 15/04*** | (2006.01) |

(52) U.S. Cl.
CPC ..... *E01F 15/14* (2013.01); *E05D 15/04* (2013.01); *E05F 15/53* (2015.01); *E05F 15/60* (2015.01); *G08G 1/095* (2013.01)

(58) Field of Classification Search
CPC . E01F 13/06; E01F 13/10; E01F 13/12; E01F 9/00; G08G 1/095
See application file for complete search history.

(56) References Cited

U.S. PATENT DOCUMENTS

| | | | | | |
|---|---|---|---|---|---|
| 5,975,791 | A * | 11/1999 | McCulloch | E01F 13/08 | 404/6 |
| 5,984,569 | A * | 11/1999 | Chou | E01F 13/12 | 14/53 |
| 6,115,963 | A * | 9/2000 | Allardyce | E01F 13/06 | 49/226 |
| 6,119,399 | A * | 9/2000 | McCain | E01F 13/06 | 49/227 |
| 6,150,958 | A * | 11/2000 | Worsham | E01F 13/085 | 340/932.2 |
| 6,857,227 | B2 * | 2/2005 | Russell | E01F 13/06 | 49/49 |
| 7,533,494 | B2 * | 5/2009 | Burke | B61L 29/22 | 49/49 |
| 7,739,834 | B2 * | 6/2010 | Stoffels | E01F 13/06 | 49/233 |
| 2005/0102872 | A1 * | 5/2005 | Seguin | E01F 9/669 | 40/601 |
| 2007/0126598 | A1 * | 6/2007 | Carter | B61L 29/023 | 340/908 |
| 2009/0074508 | A1 * | 3/2009 | Orner, Jr. | E01F 13/044 | 404/6 |

* cited by examiner

DUAL ARM FORTIFIED BARRIER ASSEMBLY

CROSS-REFERENCE TO RELATED APPLICATIONS

This patent application is a continuation of U.S. patent application Ser. No. 13/624,754, filed Sep. 21, 2012, which claims priority to and the benefit of U.S. Provisional Patent Application No. 61/537,183, filed Sep. 21, 2011, which is hereby incorporated herein by reference thereto.

TECHNICAL FIELD

Embodiments of the present invention are directed to fortified barriers, and more particularly to fortified drop arm or vertical pivot gates.

BACKGROUND

Conventional fortified barriers are designed to control traffic (vehicular or otherwise), while also deterring potential threats by vehicles to personnel and/or property. Fortified barriers configured to stop unwanted intruders from a secure area are often used in association with key assets, such as government installations, petrochemical facilities, and other protected locations. One such type of fortified barrier is a vertical pivot or drop arm gate that typically includes an arm pivotally connected at one end to a support housing. The pivot arm can rotate between a lowered blocking position and a raised, open position. The arm is typically positioned horizontally at a height that would effectively engage and restrain a medium duty truck trying to crash through the gate. This height of the arm is often at a level that may allow a smaller vehicle to pass at least partially under the arm and/or apply a vertical lifting force to the arm when the windshield and/or upper portion of the vehicle crashes into the arm, purposely or accidentally. There is a need for improved fortified barrier systems.

SUMMARY

The present invention provides a fortified barrier assembly that resolves drawbacks experienced in the prior art and provides other benefits. At least one embodiment provides a fortified dual arm barrier assembly configured to effectively stop large vehicles (e.g., medium duty trucks) and small vehicles (e.g., passenger cars) from crashing through the assembly and breaching the area being protected by the barrier assembly. One embodiment provides a fortified dual arm barrier assembly for controlling passing of a vehicle therethrough, wherein the vehicle has a frame, a body, and a windshield. As the barrier assembly includes first and second stanchions spaced apart from each other and being rigidly mountable to spaced apart mounting structures. First and second barrier arms span between the first and second stanchions. The first barrier arm is positioned substantially vertically above the second barrier arm, and the first and second barrier arms are interconnected at proximal and distal end portions. The first and second barrier arms are parallel and pivotally connected to the first stanchion for movement in an arc between closed and open positions. The distal end portions are immediately adjacent to the second stanchion when in the closed position, and the distal end portions are spaced away from the second stanchion and generally above the first stanchion when in the open position to allow the vehicle to pass unobstructed between the first and second stanchions.

The first barrier arm in the closed position is located at a selected height corresponding to an approximate height of the vehicle's windshield, and the second barrier arm in the closed position is located at a selected height corresponding approximately to the vehicle's body or frame. A first retention member is connected to the distal end portion of at least one of the first and second barrier arms. A second retention member is connected to the second stanchion and is positioned adjacent to the first retention member when the first and second barrier arms are in the closed position. The first and second retention members are configured to engage each other and prevent the first and second barrier arms from moving toward the open position when the vehicle presses against the first or second barrier arms. Hydraulic and electronic controls are fully contained in at least one of the stanchions. The hydraulic and electronic controls are coupled to the first and second barrier arms and configured to control movement of the first and second barrier arms.

Another aspect of the present disclosure provides a barrier assembly for controlling the passing of a vehicle, comprising first and second stanchions spaced apart from each other. First and second barrier arms are connected to the first stanchion and are moveable relative to the first and second stanchions between closed and open positions. The first and second barrier arms span between the first and second stanchions when in the closed position and are raised away from the second stanchion when in the open position. The first and second barrier arms are moveably coupled at proximal end portions to the first stanchion for movement between the closed and open positions. The first and second barrier arms have distal end portions immediately adjacent to and out of engagement with the second stanchion when in the closed position during normal operation with the vehicle out of engagement with the first or second barrier arms. The first barrier arm in the closed position is located at a selected first height corresponding to an approximate height of the vehicle's windshield. The second barrier arm in the closed position is located at a selected second height less than the first height and corresponding to approximately a height of the vehicle's body or frame. The second stanchion engages the distal end portion of the at least one of the first and second barrier arms only when the vehicle presses against the at least one of the first and second barrier arms, thereby securely retaining the first and second barrier arms in the closed position.

Another aspect of the disclosure provides a barrier assembly for controlling passing of a vehicle therethrough. The assembly comprises first and second stanchions, and first and second barrier arms structurally interconnected to each other at proximal and distal end portions. The first and second barrier arms are pivotally connected to the first stanchion for movement between closed and open positions. The distal end portions of the first and second barrier arms are immediately adjacent to the second stanchion when in the closed position. The first barrier arm in the closed position is spaced above the second barrier arm. The second barrier arm in the closed position is located at a selected height relative to the vehicle so at least a portion of the vehicle will extend over the second barrier arm and block the second barrier arm from moving upwardly away toward the open position when the vehicle engages the first or second barrier arm, thereby preventing the first barrier arm from being moved out of a blocking position spanning between the first and second stanchions due to the structural interconnection therebetween.

DETAILED DESCRIPTION

The present disclosure describes a fortified dual arm barrier assembly in accordance with certain embodiments of the present invention. Several specific details of the invention are set forth in the following description and the Figures to provide a thorough understanding of certain embodiments of the invention. One skilled in the art, however, will understand that the present invention may have additional embodiments, and that other embodiments of the invention may be practiced without several of the specific features described below.

Figure 1:
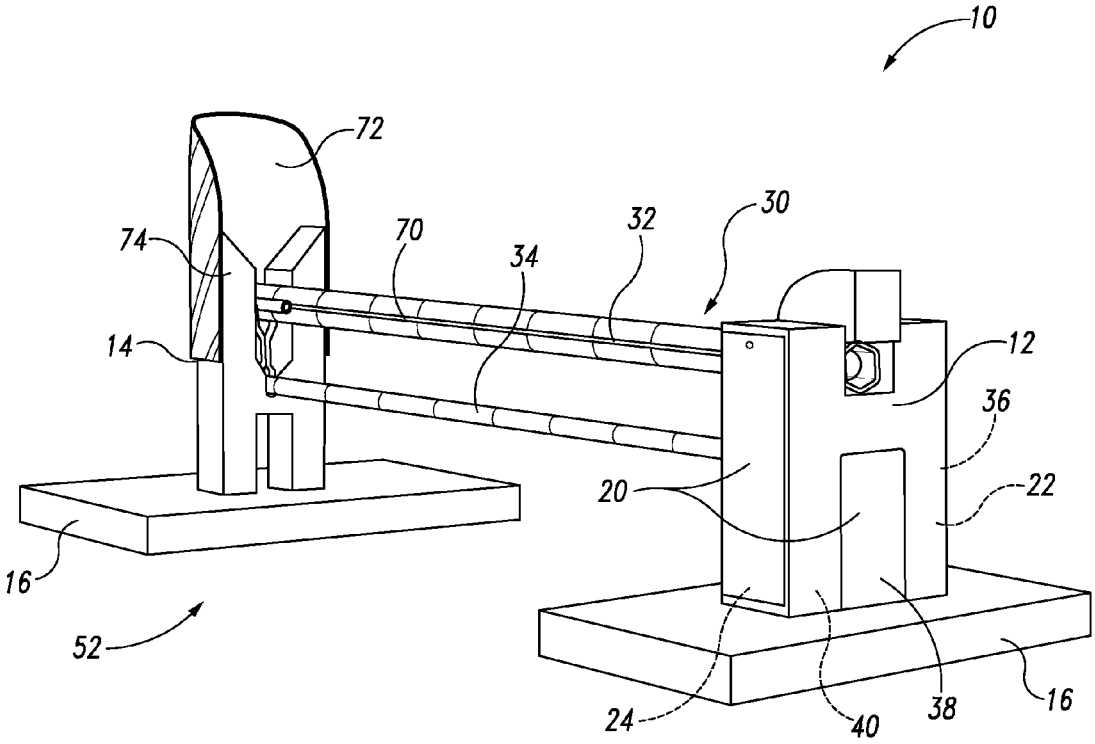
FIG. 1 is an isometric view of a fortified barrier assembly in accordance with an embodiment of the present invention.
Figure 2:
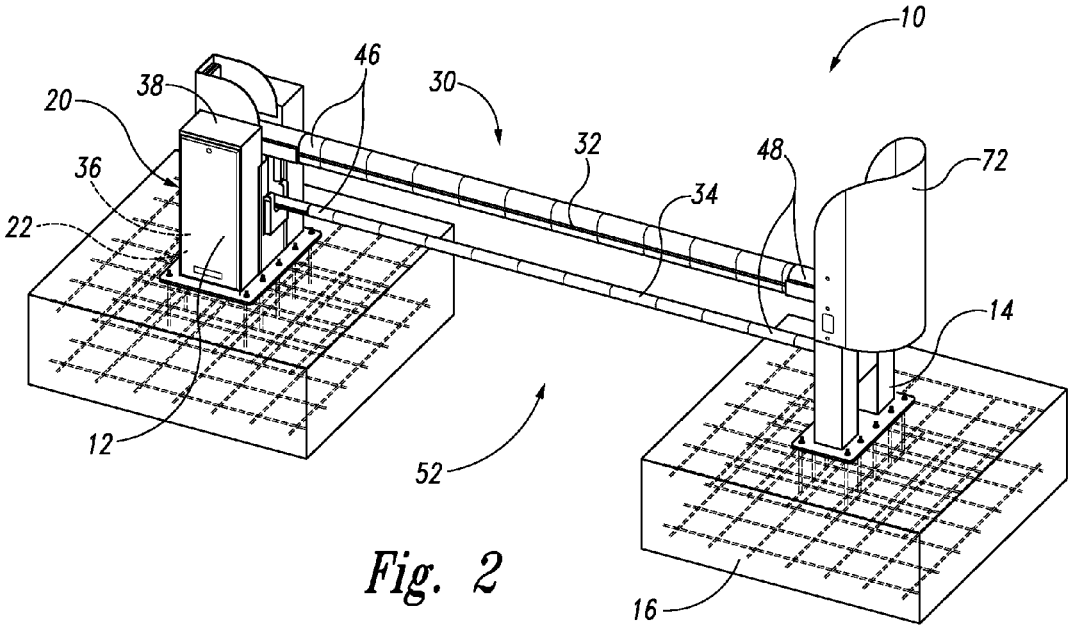
FIG. 2 is a schematic illustration of the fortified barrier assembly of FIG. 1.
Figure 3:
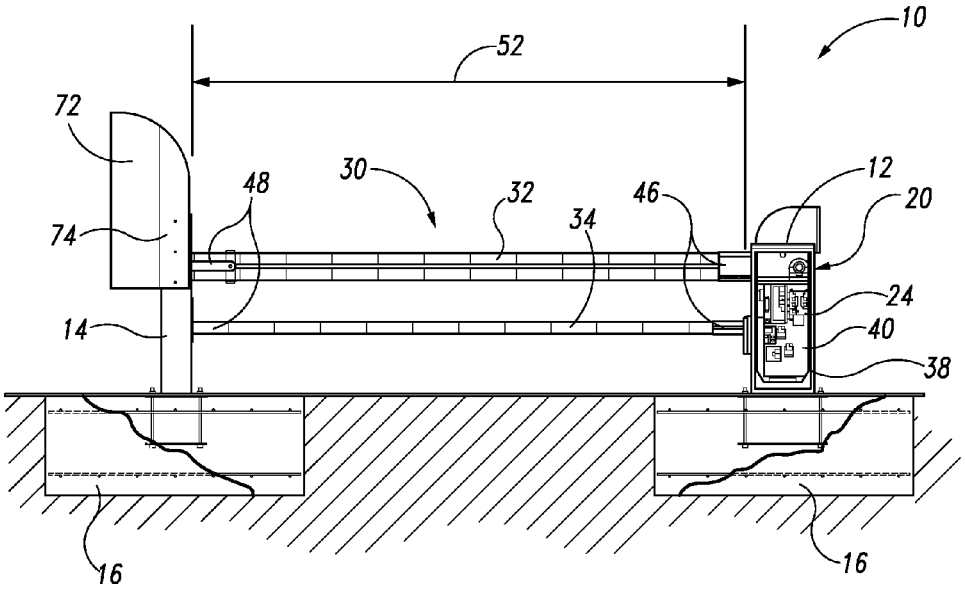
FIG. 3 is a schematic front elevation view of the fortified barrier assembly of FIG. 1.

As seen in FIGS. 1-3, the fortified dual arm barrier assembly 10 in accordance with at least one aspect of the invention provides a pair of spaced apart stanchions 12 and 14 each rigidly mounted on a secure footing 16, such as reinforced cement mounting pads. The stanchions include a primary stanchion 12 with fully self-contained hydraulic and electronic controls 20 (discussed in greater detail below) and a secondary stanchion 14 spaced apart from the primary stanchion 12. A dual barrier arm assembly 30 has upper and lower arms 32 and 34 that span between the primary and secondary stanchions 12 and 14.

The primary and secondary stanchions 12 and 14 of the illustrated embodiment are configured for use with a shallow mount footing 16 that reduces the installation time and that reduces the impact of utilities, water table, and other site concerns during installation of the barrier assembly. The plate mount design also allows a foundation construction to be used independent of other equipment installation. The self-contained controls and hydraulics reduce the need for expensive and time-consuming trenching of hydraulic hoses, wiring, etc., to a remote control panel.

Figure 4:
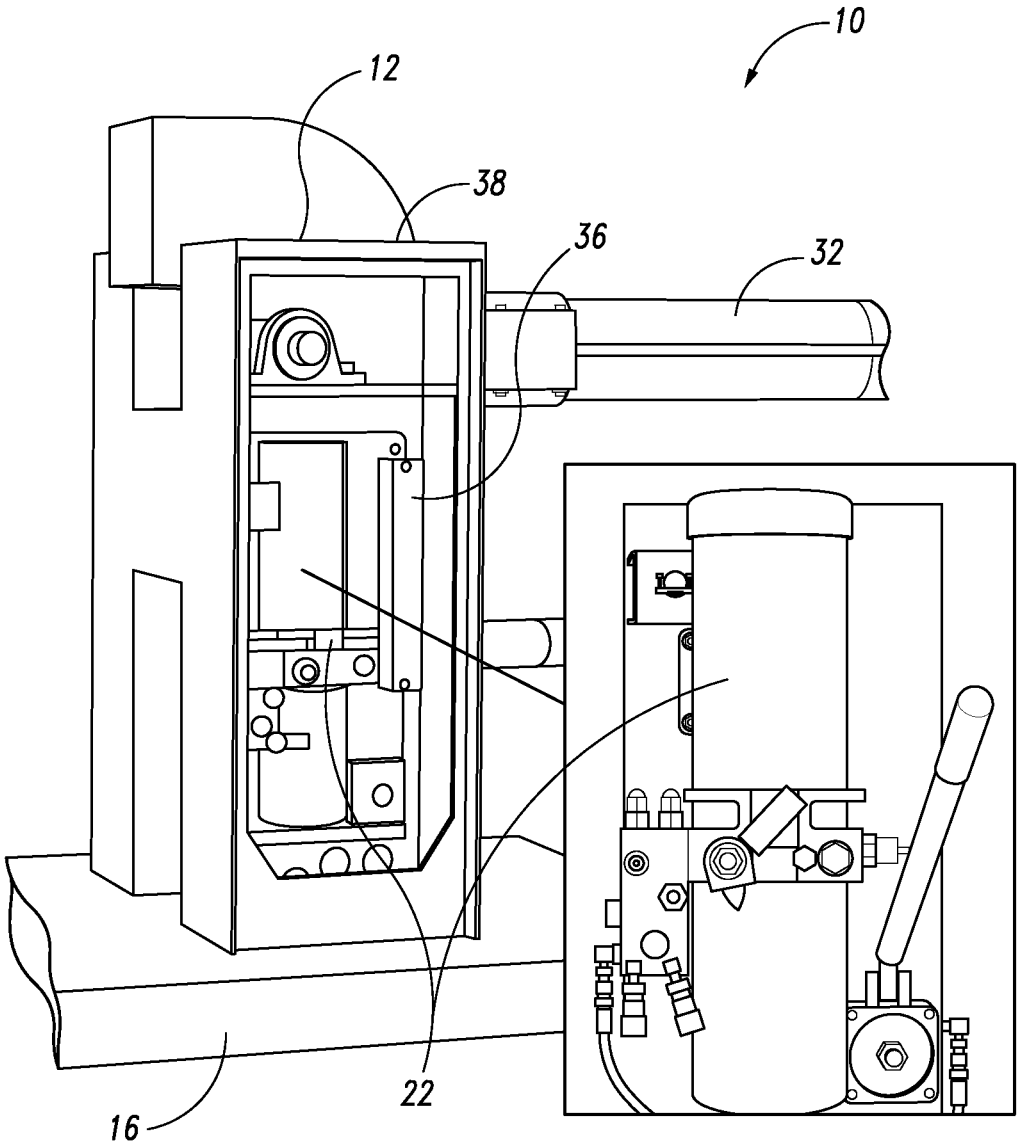
FIG. 4 is an enlarged isometric view of a primary stanchion and hydraulic controls of the fortified barrier assembly of FIG. 1.

The self-contained controls 20 include a hydraulic system 22 and an electrical control system 24, as illustrated in FIGS. 3-5, 10, 11, and 14. These controls are configured to pivotally move the upper and lower barrier arms 32 and 34 between a horizontal, lowered position and a raised position. The hydraulic system 22 and the electronic control system 24 are fully enclosed and self-contained in the primary stanchion 12. As seen in FIGS. 3 and 4, the hydraulic system 22 is fully contained in a receptacle area 36 on one side of the primary stanchion's housing 38, and the electronic control system 24 is fully contained in a receptacle area 40 on the other side of the primary stanchion's housing 38. While the illustrated embodiment shows the hydraulic system 22 and the electronic control system 24 in separate receptacle areas in the housing 38, other embodiments can include the fully contained hydraulic and electronic systems 22 and 24 in other areas or a combined area within the primary stanchion 12.

The hydraulic system 22 is configured to generate an optimized motion of the barrier arms 32 and 34 and to enable high speed and ultra smooth operation of the arms without banging or providing excess wear on the components. The hydraulic system 22 is a double acting hydraulic system that opens the barrier arms 32 and 34 to substantially a full vertical position. The hydraulic system 22 also allows for hydraulic locking of the barrier arms 32 and 34 in the closed position, thereby eliminating the need for external locking devices for the arms during normal operation between the lowered and raised positions.

Figure 5:
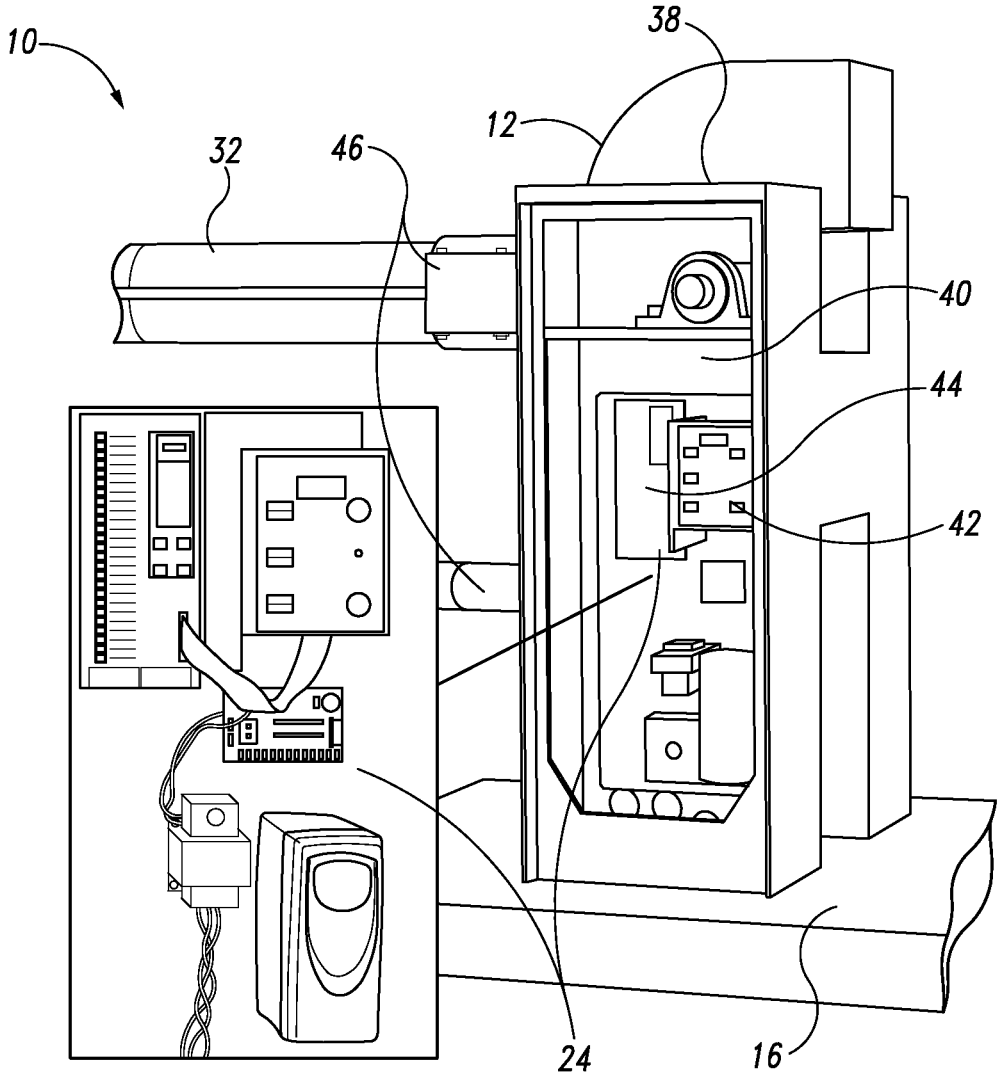
FIG. 5 is an enlarged isometric view of the primary stanchion and electronic controls of the fortified barrier assembly of FIG. 1.

The electronic control system 24 of the illustrated embodiment, shown in FIG. 5, includes a microprocessor-based control board, sold under the trade name Smart Touch Controller™. This microprocessor-based control board supplies an extensive feature set along with an RS-485-based command and control interface. The Smart Touch Controller™ and keypad are conveniently and cost effectively mounted inside a controller portion 42 of the primary stanchion 12. The electronics system 24 is configured to integrate with access control devices and security systems and to easily synchronize with other gate operators, crash gates, and accessories. An encoder 44 senses continuous arm position and enables precise motion control without the use of exposed mechanical limit switches. The electronic control system 24 can also connect to a lap top computer using a conventional computer interface to upload the operator software, download fault logs, and generate diagnostics.

Figure 6:
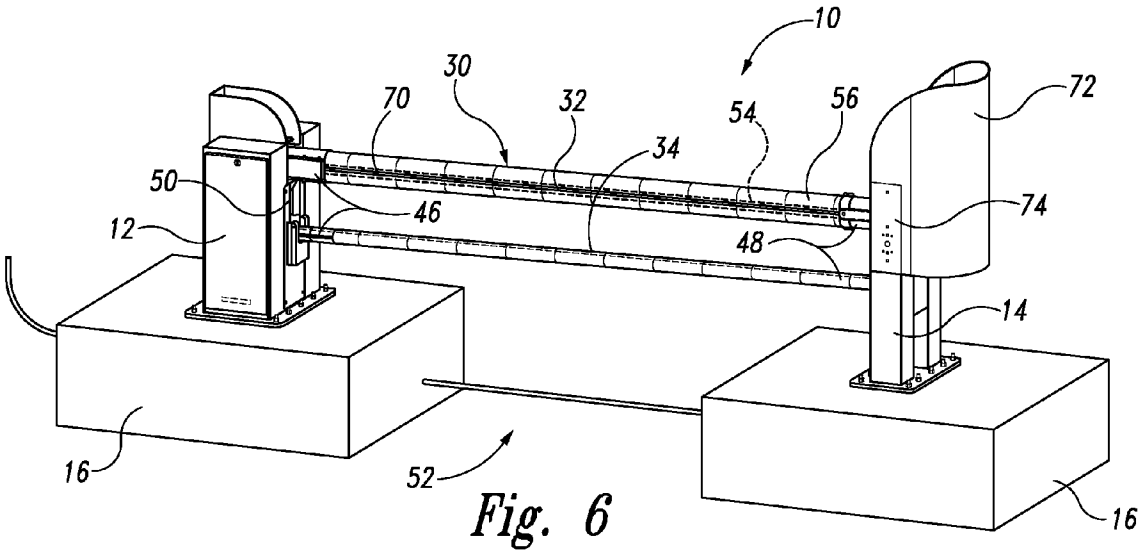
FIG. 6 is a schematic perspective view of the barrier assembly with primary and secondary stanchions mounted in secure footings.
Figure 7:
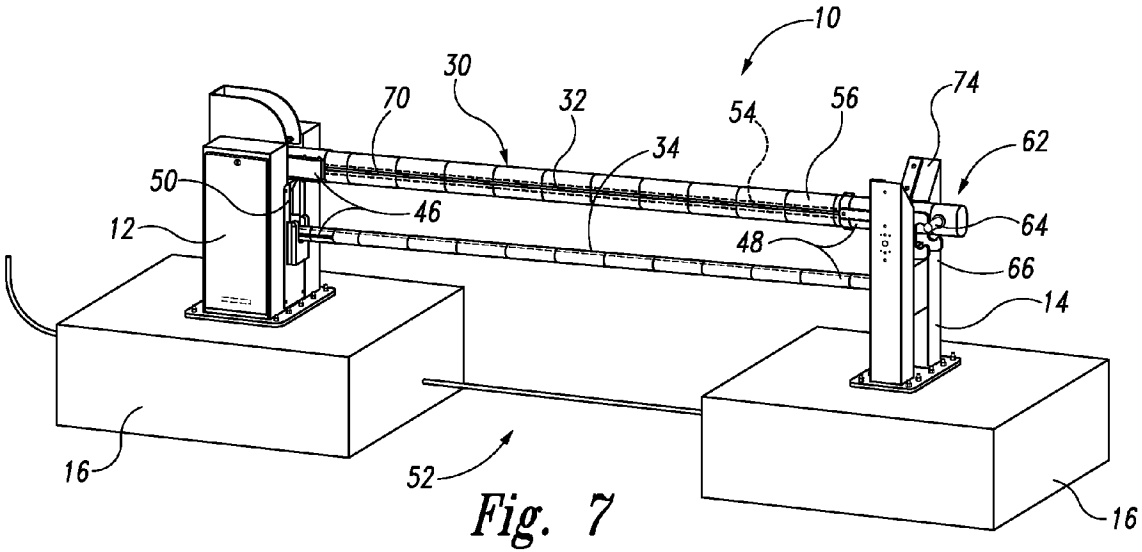
FIG. 7 is a schematic perspective view of the barrier assembly of FIG. 6 with a shield removed from a second stanchion for purposes of illustration.
Figure 8:
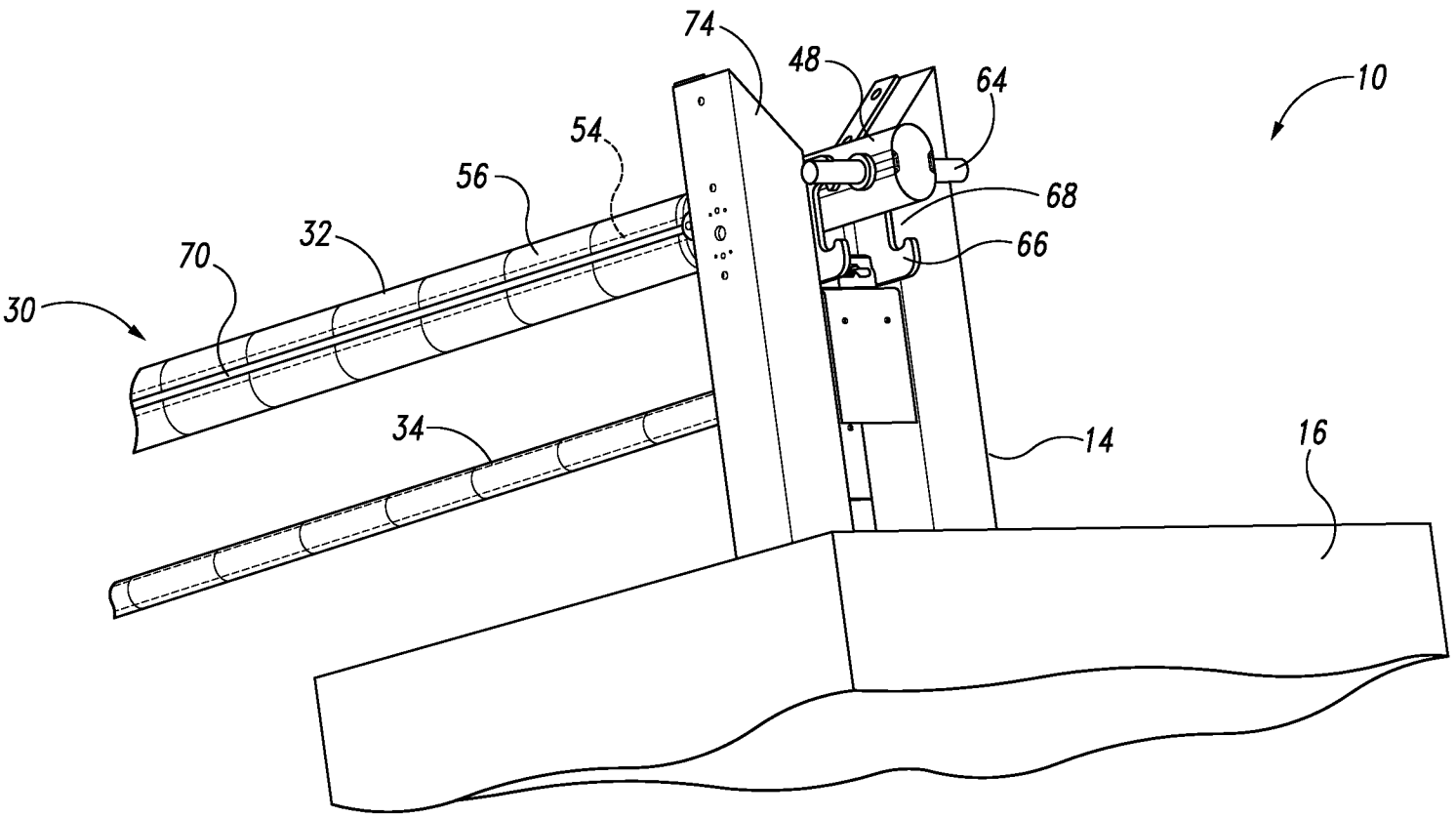
FIG. 8 is an enlarged bottom perspective view of the second stanchion and the free distal end of the upper barrier arm of the assembly of FIG. 6.
Figure 9:
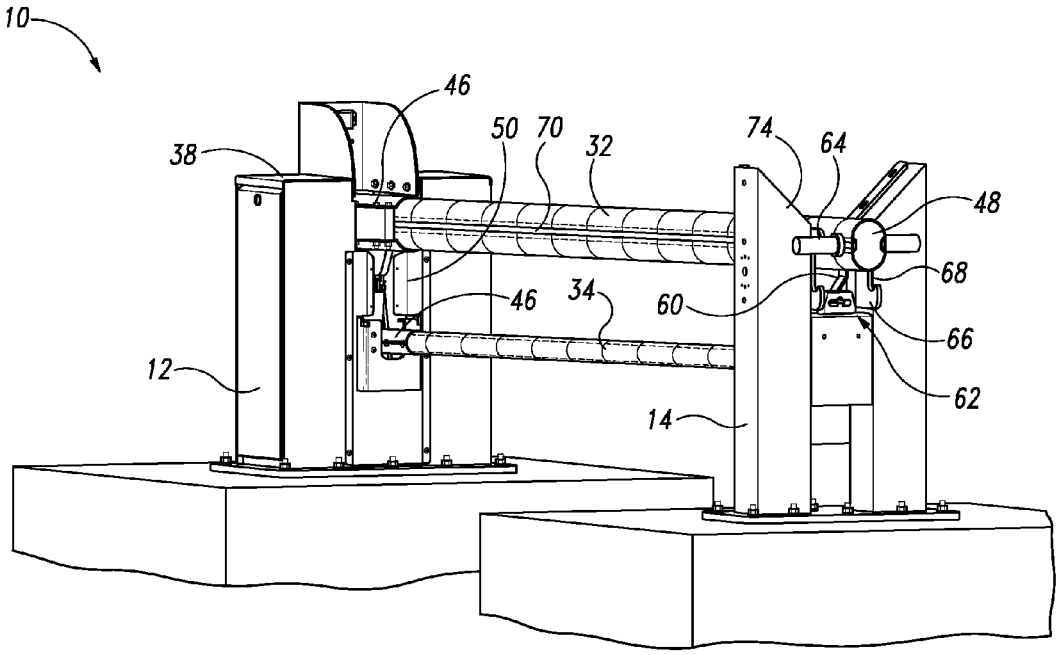
FIG. 9 is a perspective view of the barrier assembly of FIG. 6 with the shield removed from the second stanchion for purposes of clarity.
Figure 10:
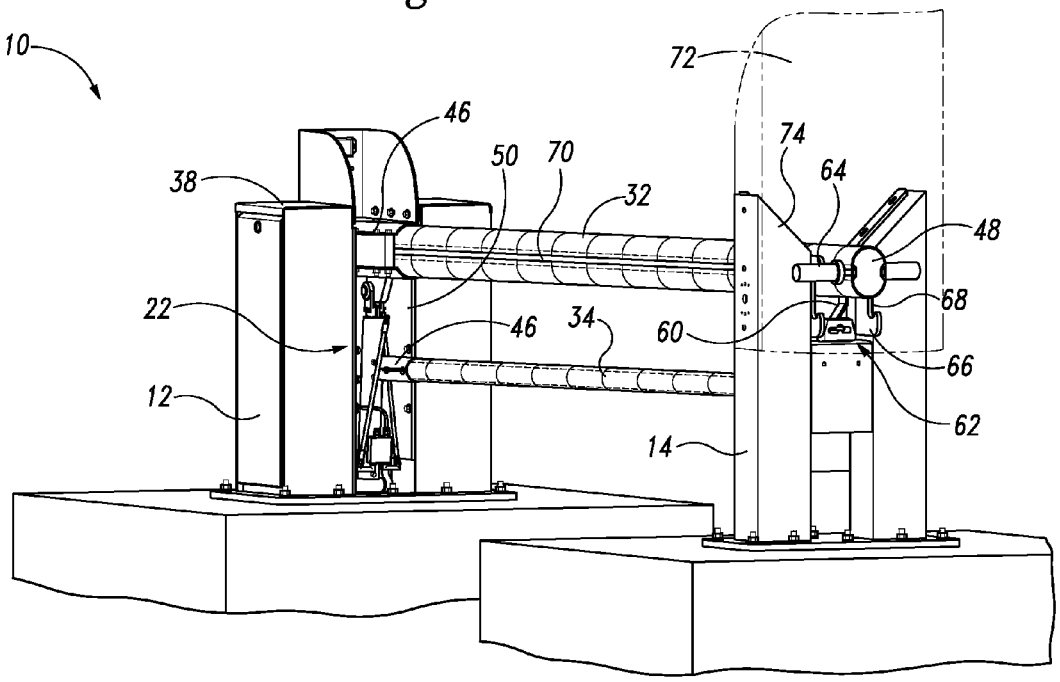
FIG. 10 is a perspective view of the barrier assembly of FIG. 6 with the shield on the second stanchions shown in phantom lines, and housing the panels should be removed from the first stanchion to illustrate the hydraulic system connected to the upper and lower barrier arms.
Figure 11:
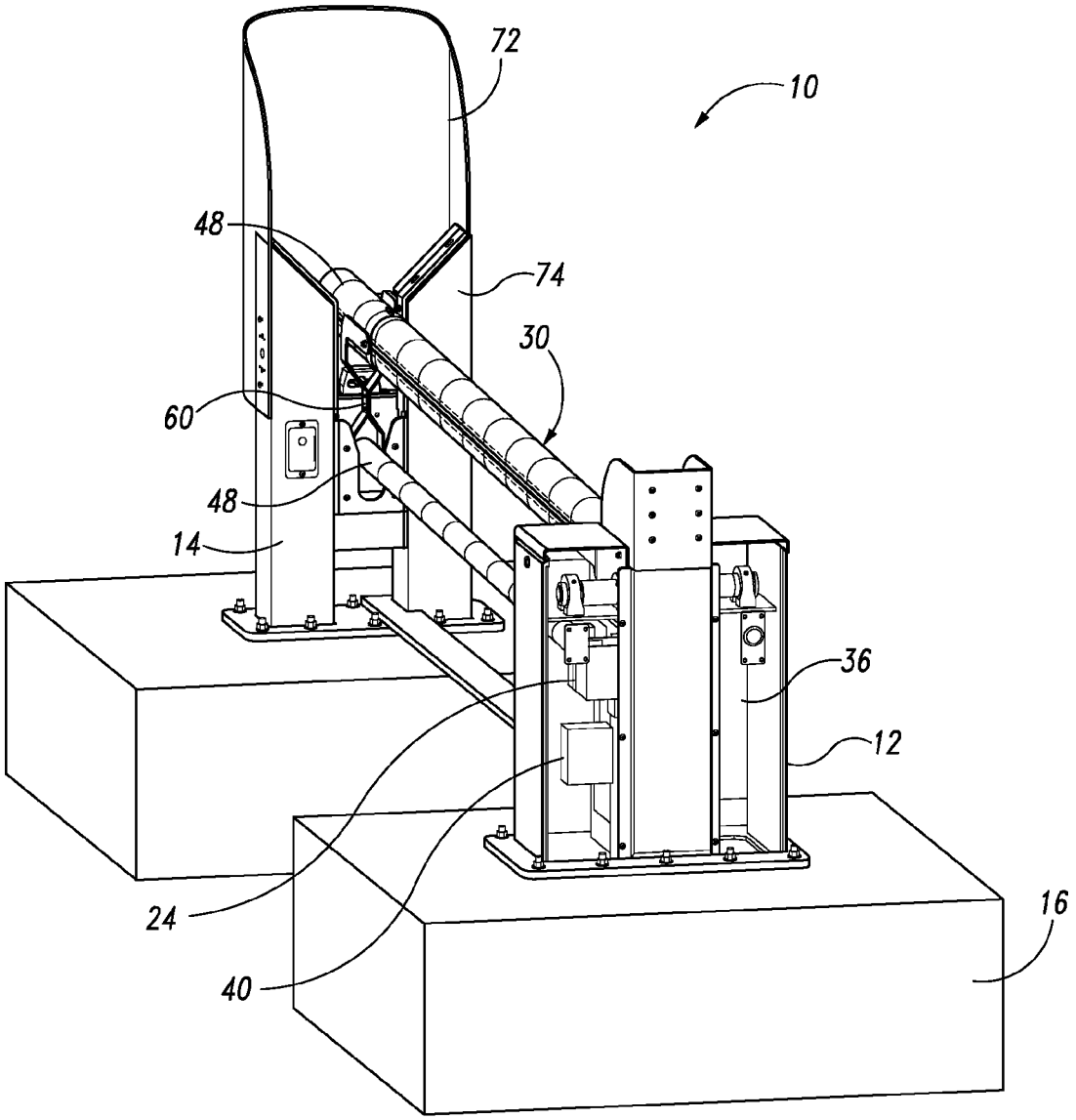
FIG. 11 is a side perspective view of the barrier assembly of FIG. 10.
Figure 12:
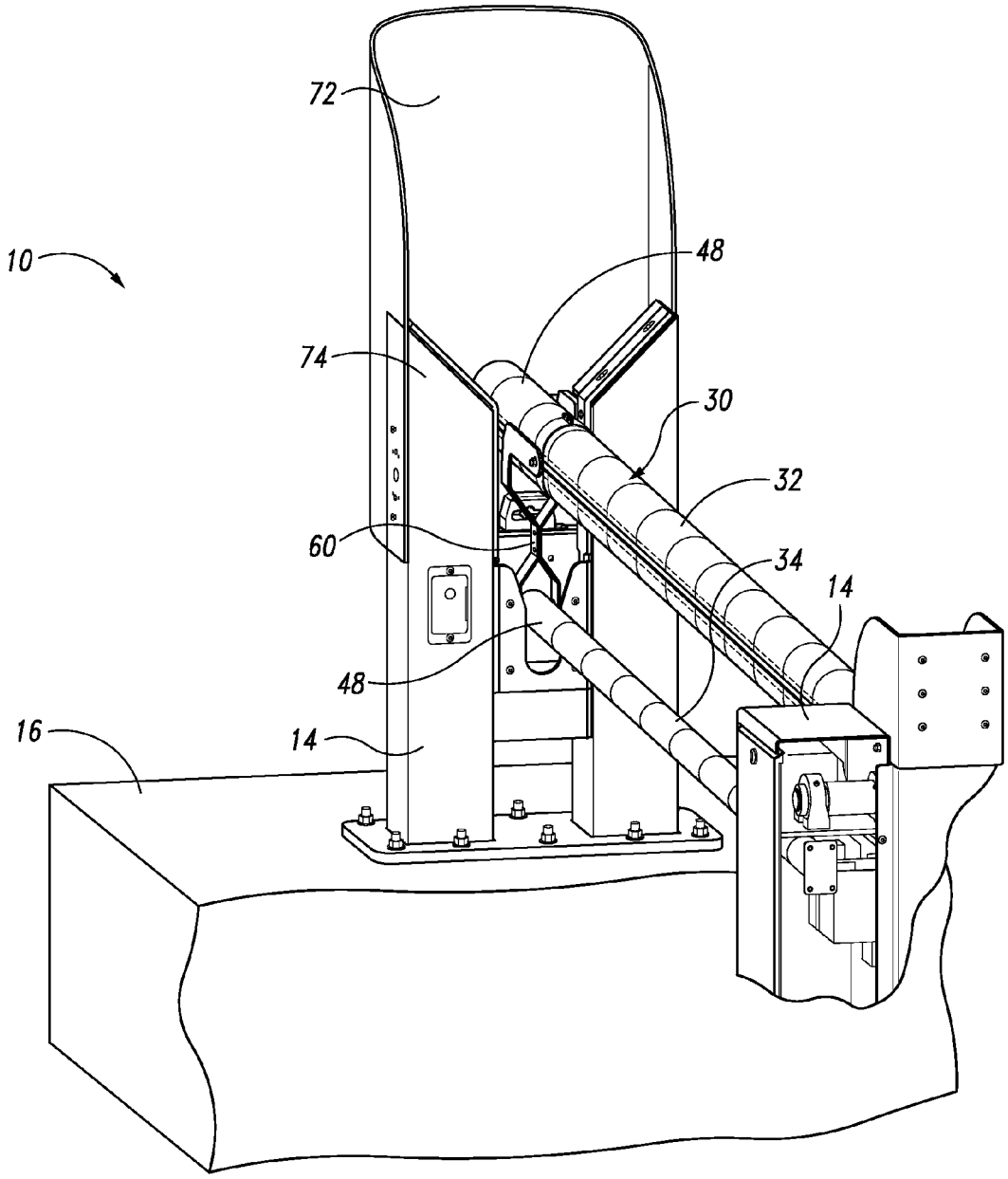
FIG. 12 is an enlarged, partial perspective view of the barrier assembly of FIG. 6 showing a linkage at the distal ends of the upper and lower barrier arms.
Figure 13:
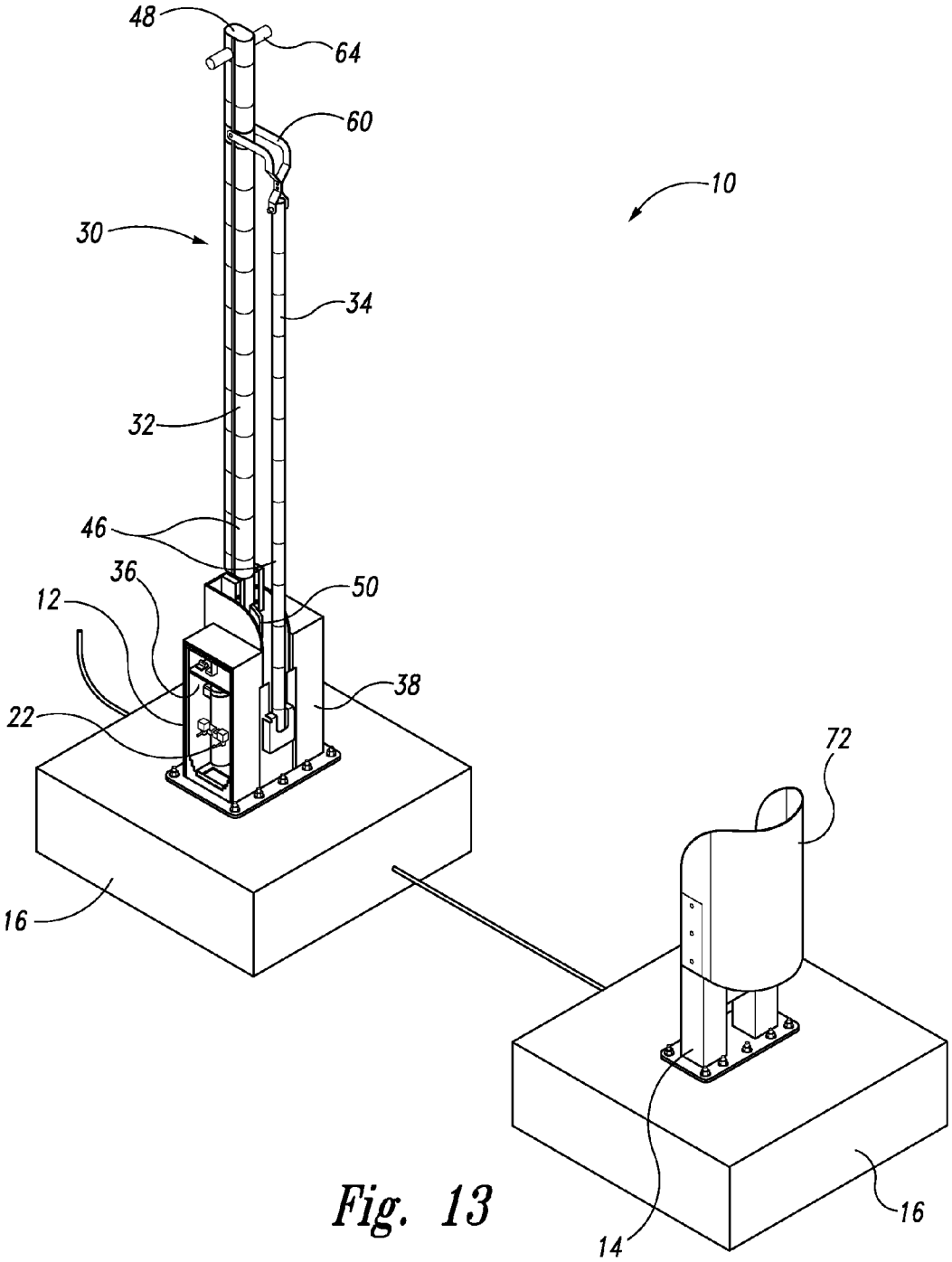
FIG. 13 is a perspective view of the barrier assembly of FIG. 6 with the barrier arms shown in the open, raised position.
Figure 14:
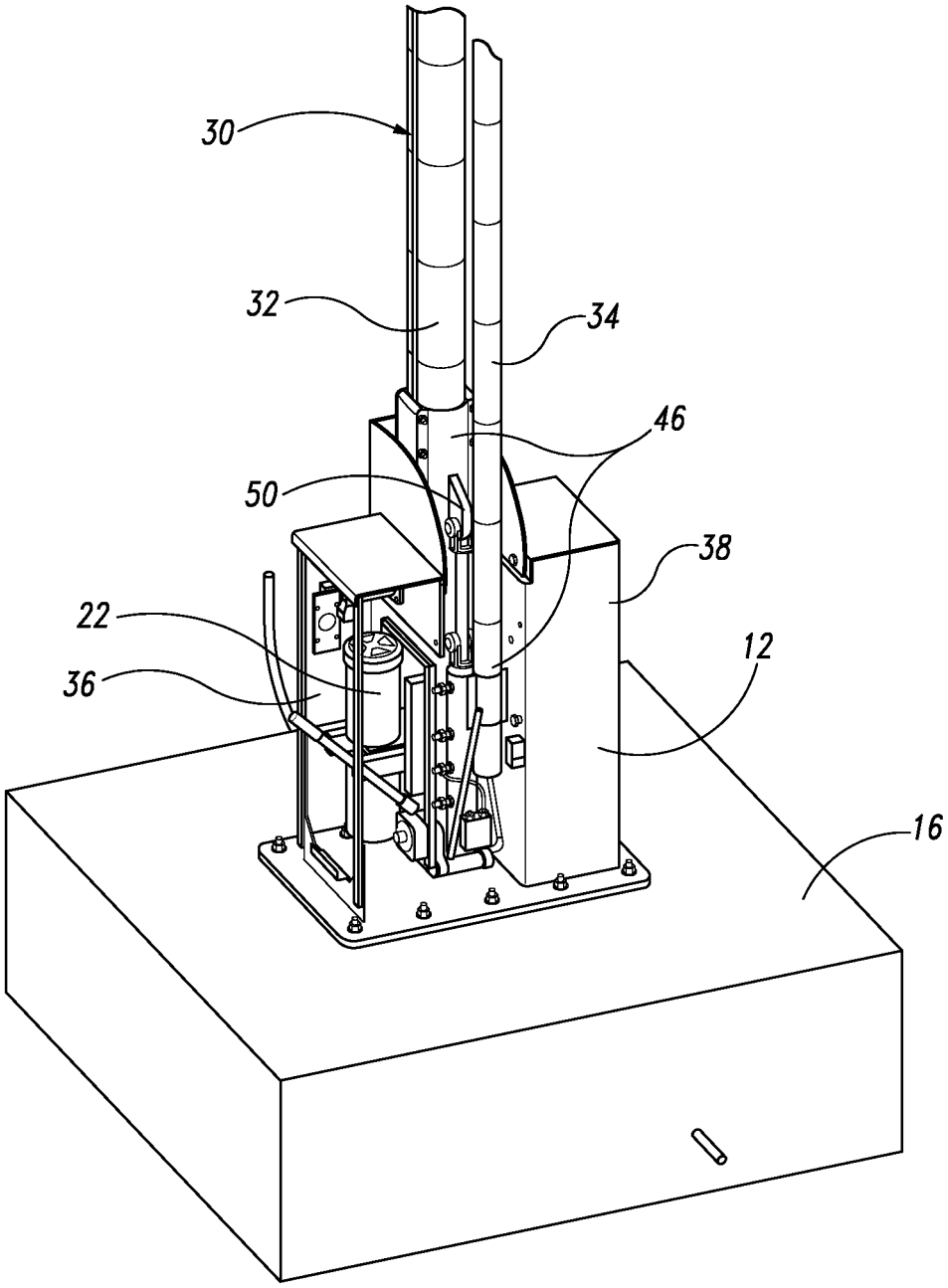
FIG. 14 is an enlarged perspective view of the first stanchion of the barrier assembly of FIG. 13 with housing panels removed to show the hydraulic system in the first stanchion.
Figure 15:
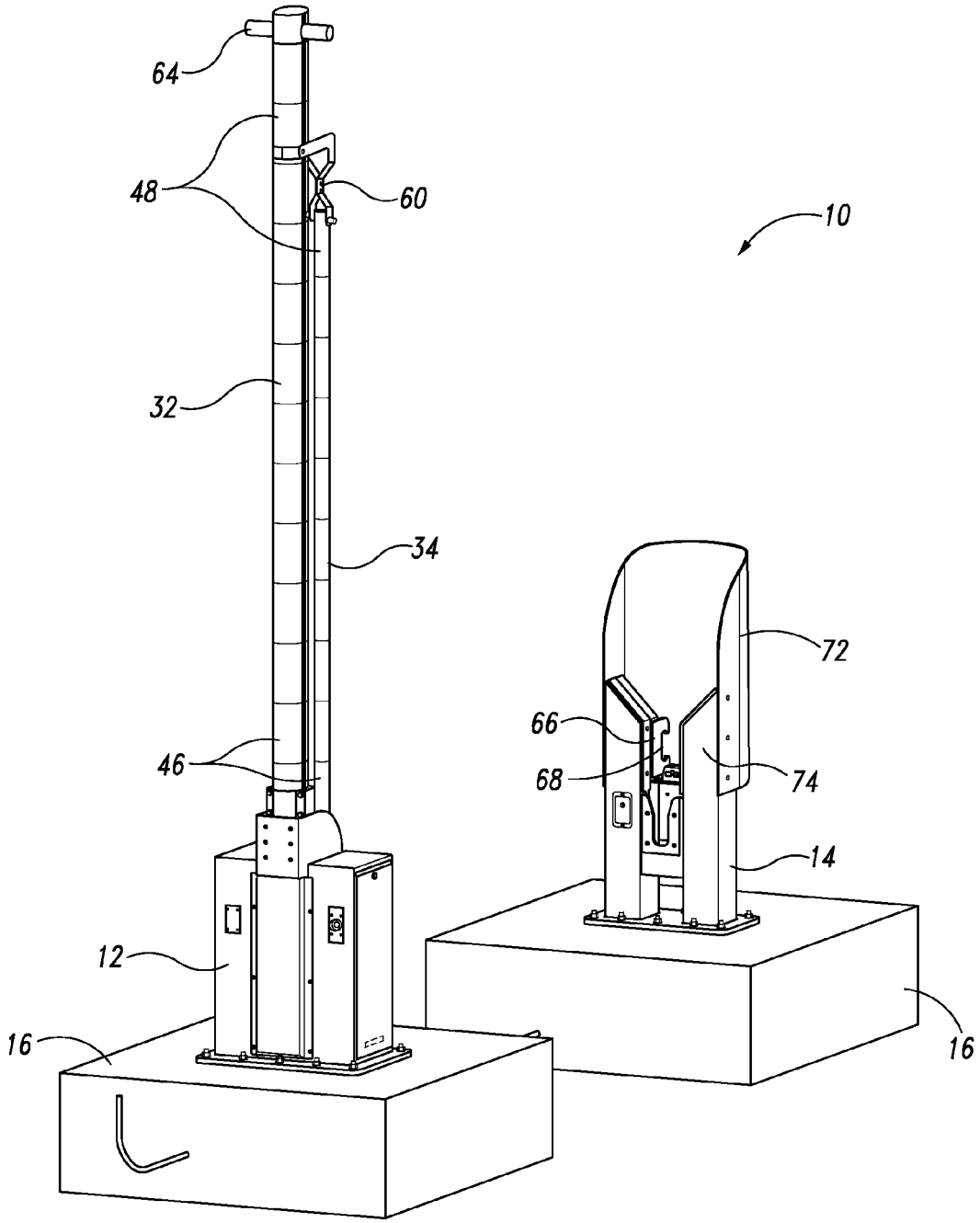
FIG. 15 is a perspective view of the barrier assembly of FIG. 6 with the barrier arms shown in the open, raised position.
Figure 16:
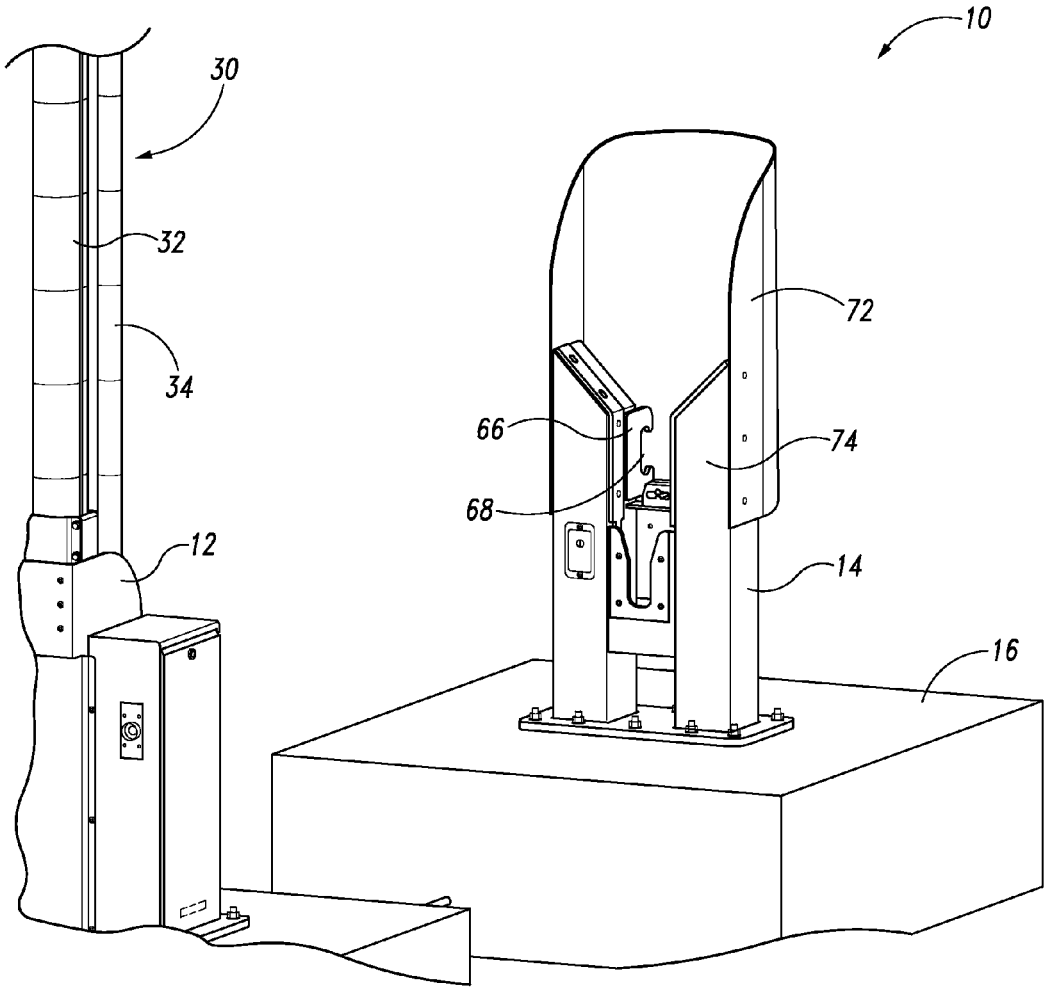
FIG. 16 is an enlarged perspective view of the second stanchion of the barrier assembly of FIG. 6.

As shown in FIGS. 6 and 7, the upper and lower barrier arms 32 and 34 are parallel and spaced apart from each other.

In the illustrated embodiment, the upper and lower barrier arms 32 and 34 are disposed in a substantially vertical plane, such that the upper arm 32 is positioned vertically above the lower arm 34. The upper and lower arms 32 and 34 are interconnected only at the proximal and distal ends 46 and 48 and are pivotally movable upon activation of the hydraulic system 22 between the lowered and raised positions. The upper and lower arms 32 and 34 pivot as a unit at the primary stanchion 12 between the lowered and raised positions. The proximal end 46 of the upper and lower arms 32 and 34 are each securely connected to the mounting structure 50 of the primary stanchion 12 and the mounting structure is attached to the hydraulic system 22. The upper and lower arms 32 and 34 each have a free distal end 48 received by the secondary stanchion 14 when the arms 32 and 34 are moved to the lowered position. When the upper and lower arms 32 and 34 are pivoted to the raised position, the free distal ends 48 of the upper and lower arms 32 and 34 are lifted upwardly and away from the second stanchion 14 along an arc, and the arms are moved to a vertical orientation, thereby moving the arms away from the space between the primary and secondary stanchions 12 and 14.

When the upper and lower arms 32 and 34 are in the lowered position, the arms 32 and 34 are substantially horizontal and extend fully across the space 52 between the primary and secondary stanchions 12 and 14, thereby blocking vehicles or the like from passing through the fortified gate. In the lowered position, the upper arm 32 is positioned at a selected height above the ground so that, when a vehicle is at the gate, the upper arm 32 will block the vehicle from passing between the stanchions 12 and 14. The upper arm 32 is a reinforced arm structure with an internal rigid bar 54 with an outer case 56. The upper arm 32 and the stanchions 12 and 14 are configured to provide the requisite stopping force in the event a larger vehicle, such as a 15,000 lbs (6.8 metric ton) medium-duty truck, intentionally or accidentally crashes into the arm. The upper arm 32 is positioned to block and/or engage the body or frame of the medium-duty truck when in the lowered position. The fortified stanchions 12 and 14 securely support the proximal and distal ends 46 and 48 of the upper arm 32 in the lowered position to retain the arm across the space 52 between the stanchions 12 and 14 and to provide the stopping force to the vehicle.

The lower arm 34 is spaced below the upper arm 32 and is arranged at a distance above the ground that will block, engage, and stop the body or frame of a smaller vehicle, such as a passenger vehicle, in the event it crashes into the barrier assembly 10. The position of the lower arm 34 blocks the smaller vehicle from passing fully between the stanchions 12 and 14 with sufficient stopping force. The upper arm 32 is positioned to be aligned approximately with the windshield and/or top portion of the smaller vehicle. If the lower arm 34 was not provided, a smaller vehicle could pass partially under the upper arm 32, such that the upper arm 32 would engage the windshield or roof area of the vehicle. By allowing a vehicle to even partially extend under the upper arm 32 would be an unacceptable breach between the stanchions 12 and 14. In addition, a smaller vehicle traveling fast enough could possibly breach the security gate area if the windshield and roof structure were severed from the vehicle by the upper arm as the vehicle passes between the stanchions 12 and 14. In addition, a smaller vehicle passing under just the upper arm 32 would actually impart a vertical lifting force to the upper arm, which has the possibility of allowing the smaller vehicle to pass even further under the upper arm.

The lower arm 34 of the dual arm assembly 30 in accordance with the current embodiment is positioned to provide the blocking and stopping force for the body or frame of the smaller vehicle before the smaller vehicle contacts or engages the upper arm 32. Accordingly, the lower arm 34 provides a structure that the smaller vehicle may engage first, such as upon an accidental or intentional impact with the barrier arms 32 and 34. The lower arm 34 will also help protect the smaller vehicle from excessive damage to the windshield and roof area by the upper arm 32, particularly in the event of an inadvertent impact with the fortified barrier assembly 10.

As seen in FIGS. 9-12, the upper and lower arms 32 and 34 are joined together at their distal ends 48 by a linkage assembly 60 that allows both upper and lower arms 32 and 34 to move simultaneously between the lowered and upper position. The lower arm 34 is positioned relative to the upper arm 32 such that, when a truck attempts to crash through the barrier arms 32 and 34, the body or frame of the truck may partially pass over the top of the lower arm 34 as the vehicle crashes into the arms. The weight of the vehicle on the lower arm 34 will hold the lower arm in the lowered position. Accordingly, by structurally joining the free distal ends 48 of the upper and lower arms 32 and 34, the weight of the vehicle pressing down on the lower arm 34 also hold the reinforced upper arm 32 to also be held down in the lowered position.

As seen in FIGS. 7-10, 15, and 16 the barrier assembly 10 of the present invention also includes retention structures 62 in the secondary stanchion 14 positioned to receive and engage a retention bar 64 mounted on the distal end 48 of the upper arm 32 when a vehicle crashes into the arms 32 and 34. This engagement between the retention structure 62 and the retention bar 64 effectively lock the distal ends 48 of the upper and lower arms 32 and 34 in the lowered position. In one embodiment, the retention structures 62 include C-shaped brackets 66 positioned slightly longitudinally away from the distal ends 48 of the upper and lower arms 32 and 34. The C-shaped brackets 66 are positioned with the opening of the bracket facing toward the retention bar 64 on the distal end 48 of the upper arm 32. The retention bar 64 is perpendicular to the longitudinal axis of the upper arm 32 and in alignment with the openings of the C-shaped brackets 66. When a vehicle or the like crashes into the upper and lower arms 32 and 34 with sufficient force, the upper arm 32 may bend or buckle and draw the retention bar 64 longitudinally rearward toward the primary stanchion, thereby drawing the retention bar into the C-shaped brackets 66 through the bracket openings. Once the retention bar 64 is moved into the brackets 66, the brackets engage the retention bar 64 and prevent vertical motion of the upper and lower arms 32 and 34 away from the lowered position. The fortified secondary stanchion 14 provides the anchoring force to hold the distal ends 48 of the arms 32 and 34 in place and to withstand the forces of a vehicle crashing into the upper and lower arms 32 and 34, thereby preventing breach between the stanchions 12 and 14.

When the upper and lower arms 32 and 34 are operating in a normal fashion through movement between the lowered and raised positions, the retention bar 64 is spaced longitudinal forward of the retention brackets 66. The free distal ends 48 are therefore free to move into and out of the secondary stanchion 14 as the arms 32 and 34 move between the raised and lowered positions. The linkage 60 at the distal ends 48 of the upper and lower arms 32 and 34 help maintain the lateral stability of the arms throughout their motion between the lowered and raised positions. This arrangement, in conjunction with the fully contained hydraulic and electronics systems 22 and 24 in the primary stanchion 12, allows for very fast arm speed while moving between the lowered and raised positions. Such increased speed helps to reduce traffic backup by minimizing the gate open time, thereby allowing more authorized vehicles per hour to pass through the fortified gate assembly. The fast arm speed also allows for fast arm deployment in response to a threat, such as during an "emergency fast close" condition.

The dual arm barrier assembly 10 of the illustrated embodiment includes a plurality of LED lights 70 embedded along the upper arm 32 to provide a visual indicator or a visual identifier to vehicles approaching the arms when in the lowered position. The LED arm lights 70 are controlled by the electronic control system 24. The electronic control system 24 can be programmed to turn on or off the LED lights 70 in accordance with a selected program. The lights 70 can also be configured to flash, such as when the arms 32 and 34 are to be raised and/or lowered. The illustrated embodiment also can be configured with a stoplight assembly connected to, as an example, the primary stanchion 12, to provide a stop/go indicator to a vehicle seeking to pass between the stanchions 12 and 14 during normal use and operation.

In the embodiment illustrated in FIGS. 1 and 6, an entrapment shield 72 is connected to the top portion 74 of the secondary stanchion 14. This entrapment shield 72 extends around the open top area of the secondary stanchion 14 where the lower and upper arms 32 and 34 pass into and out of the secondary stanchion structure. The entrapment shield 72 does not interfere with movement of the upper and lower arms 32 and 34 during normal operation. The entrapment shield 72 does, however, provide a blocking structure that blocks pedestrians from reaching into the space in the secondary stanchion 14 through which the lower and upper arms 32 and 34 pass. Other embodiments can be provided without the entrapment shield or with other structures that helps protect the secondary stanchion 14 and the free distal ends 48 of the upper and/or lower arms 32 and 34.

From the foregoing, it will be appreciated that specific embodiments of the invention have been described herein for purposes of illustration, but that various modifications may be made without deviating from the invention. Additionally, aspects of the invention described in the context of particular embodiments or examples may be combined or eliminated in other embodiments. Although advantages associated with certain embodiments of the invention have been described in the context of those embodiments, other embodiments may also exhibit such advantages. Additionally, not all embodiments need necessarily exhibit such advantages to fall within the scope of the invention. Accordingly, the invention is not limited except as by the appended claims.

We claim:

1. A fortified dual arm barrier assembly for controlling passing of a vehicle therethrough, the vehicle having a frame, a body, and a windshield, comprising:

first and second stanchions spaced apart from each other and being rigidly mountable to spaced apart mounting structures, the second stanchion having a pair of spaced apart posts defining a receiving area therebetween;

a retention structure connected to the second stanchion in the receiving area, the retention structure comprises a pair of C-shaped brackets spaced apart from each other, the C-shaped brackets being positioned with bracket openings facing horizontally away from the first stanchion;

first and second barrier arms that span between the first and second stanchions, the first and second barrier arms being structurally interconnected only at proximal and distal end portions, the first and second barrier arms being parallel and pivotally connected to the first stanchion for movement in an arc between closed and open positions, the distal end portions being positioned in the receiving area with distal ends being positioned longitudinally away from the C-shaped brackets when the first and second barrier arms are in the closed position, wherein the first barrier arm in the closed position is spaced above the second barrier arm, and the distal end portions being spaced away from the second stanchion and generally above the first stanchion when in the open position to allow the vehicle to pass unobstructed between the first and second stanchions, wherein the first barrier arm in the closed position being located at a selected height corresponding to an approximate height of the vehicle's windshield, and the second barrier arm in the closed position being located at a selected height relative to the vehicle so at least a portion of the vehicle will extend over the second barrier arm and block the second barrier arm from moving upwardly away toward the open position when the vehicle engages the first or second barrier arm, thereby preventing the first barrier arm from being moved out of a blocking position spanning between the first and second stanchions due to the structural interconnection therebetween;

a retention bar connected to the distal end of the first barrier arm and oriented substantially perpendicular to a longitudinal axis of the first barrier arm, wherein the openings of the C-shaped brackets facing toward the retention bar when the first barrier arm is in the closed position, and wherein the first barrier arm and the retention bar are adapted so the first barrier can bend and draw the retention bar longitudinally through the openings and into the C-shaped brackets to prevent vertical movement of the first and second barrier arms away from the lowered position when a vehicle engages the first and second barrier arms; and hydraulic and electronic controls fully contained in at least one of the first and second stanchions, the hydraulic and electronic controls coupled to the first and second barrier arms and configured to control movement of the first and second barrier arms.

2. The assembly of claim 1 wherein the hydraulic and electronic controls are fully contained in the first stanchion.

3. The assembly of claim 1 wherein first stanchion has a pivotable mounting structure coupled to the hydraulic and electronic controls, and the proximal end portions of the first and second barrier arms are securely connected to a mounting structure.

4. The assembly of claim 1 wherein the first and second barrier arms have a linkage member interconnecting the distal end portions of the first and second barrier arms, the linkage assembly allows the first and second barrier arms to move together as a unit between the closed and open positions.

5. The assembly of claim 1 wherein the distal end portions of the first and second barrier arms are structurally interconnected wherein, when the vehicle presses against the first and second barrier arms in the closed position and the vehicle extends at least partially over the second barrier arm, the first barrier arm is prevented from moving away from the closed position.

6. The assembly of claim 1 wherein the retention bar is spaced longitudinally forward of and out of engagement with the retention structure relative to the at least one of the first and second barrier arms, wherein the distal end portions of the first and second barrier arms are free to move into and out of the second stanchion during normal operation without interference between the retention bar and the retention structure.

7. The assembly of claim 1, further comprising a plurality of lights disposed on at least one of the first and second barrier arms and operatively connected to an electronic control system of the hydraulic and electronic controls.

8. The assembly of claim 1, further comprising a shield connected to the top portion of the second stanchion and extending around an open top area of the second stanchion in which the distal end portions of the first and second barrier arms pass into and out of the second stanchion.

9. A barrier assembly for controlling passing of a vehicle, comprising:

first and second stanchions spaced apart from each other, the second stanchion having a pair of spaced apart posts defining a receiving area therebetween;

a retention structure connected to the second stanchion in the receiving area, the retention structure comprises a pair of C-shaped brackets spaced apart from each other, the C-shaped brackets being positioned with bracket openings facing horizontally away from the first stanchion;

first and second barrier arms connected to the first stanchion and moveable relative to the first and second stanchions between closed and open positions, the first and second barrier arms span between the first and second stanchions when in the closed position and being raised away from the second stanchion when in the open position, the first and second barrier arms being moveably coupled at proximal end portions to the first stanchion for movement between the closed and open positions, first and second barrier arms having distal end portions being positioned in the receiving area with distal ends being positioned longitudinally away from the C-shaped brackets when the first and second barrier arms are in the closed position during normal operation with the vehicle out of engagement with the first or second barrier arms, the first and second barrier arms structurally interconnected to each other only at the proximal and distal end portions wherein the first barrier arm in the closed position being located at a selected first height corresponding to an approximate height of the vehicle's windshield, and the second barrier arm in the closed position being located at a selected second height less than the first height relative to the vehicle so at least a portion of the vehicle will extend over the second barrier arm and block the second barrier arm from moving upwardly away toward the open position when the vehicle engages the first or second barrier arm, thereby preventing the first barrier arm from being moved out of a blocking position spanning between the first and second stanchions due to the structural interconnection therebetween; and a retention bar connected to the distal end of the first barrier arm and oriented substantially perpendicular to a longitudinal axis of the first barrier arm, wherein the openings of the C-shaped brackets facing toward the retention bar when the first barrier arm is in the closed position, and wherein the first barrier arm and the retention bar are adapted so the first barrier can bend and draw the retention bar longitudinally through the openings and into the C-shaped brackets to prevent vertical movement of the first and second barrier arms away from the lowered position when a vehicle engages the first and second barrier arms.

10. The assembly of claim 9, further comprising a fully contained electronic control system and a fully contained hydraulic system coupled to the first and second barrier arms.

11. The assembly of claim 10 wherein the hydraulic system is fully contained in the first stanchion.

12. The assembly of claim 9 wherein the first and second barrier arms are substantially parallel and pivotable through an arc relative to the first stanchion when moving between the closed and open positions.

13. The assembly of claim 9 wherein the first and second barrier arms have a linkage member interconnecting the distal end portions of the first and second barrier arms, the linkage member allows the first and second barrier arms to move together as a unit between the closed and open positions.

14. The assembly of claim 9, further comprising a hydraulic control system coupled to the first and second barrier arms and configured to move the first and second barrier arms between the closed and open positions, and configured to hold the first and second barrier arms in the closed position.

* * * * *